US009476563B2

(12) United States Patent
Lee

(10) Patent No.: US 9,476,563 B2
(45) Date of Patent: Oct. 25, 2016

(54) LAMP DESIGN METHOD FOR AUTOMOBILE

(71) Applicant: HYUNDAI MOBIS CO., LTD., Seoul (KR)

(72) Inventor: Hyuk Min Lee, Yongin (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 14/677,785

(22) Filed: Apr. 2, 2015

(65) Prior Publication Data

US 2015/0377436 A1 Dec. 31, 2015

(30) Foreign Application Priority Data

Jun. 30, 2014 (KR) ..... 10-2014-0080724

(51) Int. Cl.
*F21S 8/10* (2006.01)
*F21Y 103/00* (2016.01)

(52) U.S. Cl.
CPC ..... *F21S 48/215* (2013.01); *F21S 48/218* (2013.01); *F21Y 2103/003* (2013.01)

(58) Field of Classification Search
CPC F21S 48/215; F21S 48/218; F21Y 2103/003
USPC ..... 362/487, 544, 545
See application file for complete search history.

(56) References Cited

U.S. PATENT DOCUMENTS

2009/0027885 A1* 1/2009 Hoshi ..... G02B 5/045 362/244
2010/0201910 A1* 8/2010 Iiyama ..... G02F 1/133603 349/61
2012/0230008 A1* 9/2012 Ajichi ..... G02F 1/133536 362/19
2013/0027955 A1* 1/2013 Grote, III ..... F21K 9/00 362/510
2013/0278865 A1* 10/2013 He ..... G09F 13/04 349/64

* cited by examiner

*Primary Examiner* — Laura Tso

(57) ABSTRACT

The present invention relates to a lamp design method for an automobile. The present invention makes functions of a pitch between light sources and an air gap to be applied to the design in order to improve light uniformity. The present invention may suggest an optimal design method of an FDT surface light source lamp.

10 Claims, 2 Drawing Sheets

<PRIOR ART>

<PRIOR ART>

LAMP DESIGN METHOD FOR AUTOMOBILE

CROSS-REFERENCE TO RELATED APPLICATIONS

This application claims priority to and the benefit of Korean Patent Application No. 10-2014-0080724 filed in the Korean Intellectual Property Office on Jun. 30, 2014, the entire contents of which are incorporated herein by reference.

TECHNICAL FIELD

The present invention relates to a lamp design method for an automobile, and more particularly, to a lamp design method for an automobile which suggests an optimal design method of an FDT surface light source lamp.

BACKGROUND ART

Generally, a light emission method of an automobile lamp may be divided into a reflective type or an indirect type which has a general structure and a direct type which has a fluorescent discharge tube (FDT) structure.

In the case of a reflective type or an indirect type as illustrated in FIG. 1, in a light source 10, such as an LED, due to secondary reflection, light loss may occur, light efficiency is reduced, and many LEDs are required while improving light uniformity. However, in the case of the direct type as illustrated in FIG. 2, the light source 10 such as an LED emits light without reflecting the light, so that light uniformity is increased and the number of LEDs is reduced.

Since a design method which may improve the light uniformity of the FDT surface light source has currently progressed through a number of trial and error, lots of labors and a lot time are allocated so that a method for a mathematized optimal lamp design for an automobile which may solve the above-mentioned technical problems is acutely demanded.

SUMMARY OF THE INVENTION

The present invention has been made in an effort to provide a lamp design method for an automobile which may suggest an optimal design method of an FDT surface light source lamp.

An exemplary embodiment of the present invention provides a lamp design method for an automobile, in which functions of a pitch between light sources and an air gap are combined and applied to a design in order to improve light uniformity.

The pitch may be 50 to 80 mm.

The air gap may be 20 to 40 mm.

$$\text{Light uniformity}=0.962046+0.00623107\times(\text{air gap})-0.00444847\times(\text{pitch}).$$

The uniformity of the light source may be applied to light uniformity of an LED direct type surface light source.

According to the lamp design method for an automobile according to the present invention, a lamp design method for an automobile which may suggest an optimal design method of an FDT surface light source lamp may be provided.

Uniformity may be improved and the number of LEDs may be reduced.

The number of trial and error required for improving light uniformity of an FDT surface light source may be significantly reduced.

The foregoing summary is illustrative only and is not intended to be in any way limiting. In addition to the illustrative aspects, embodiments, and features described above, further aspects, embodiments, and features will become apparent by reference to the drawings and the following detailed description.

Figure 1:
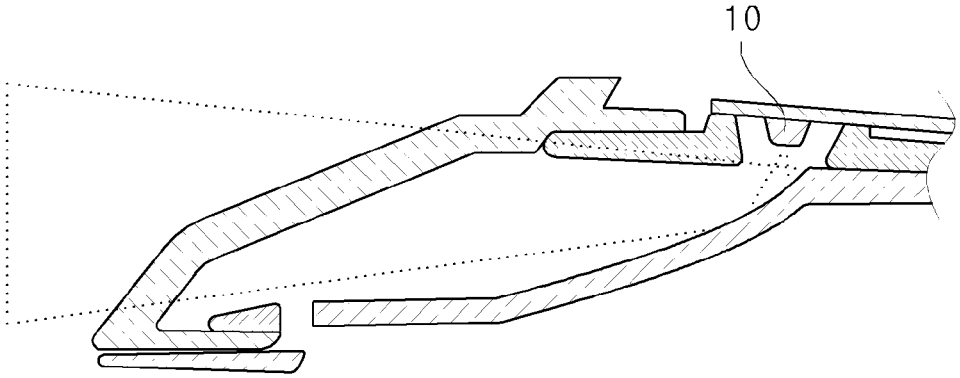
FIG. 1 is a view illustrating a direct type or an indirect type light source emitting method of a related art.
Figure 2:
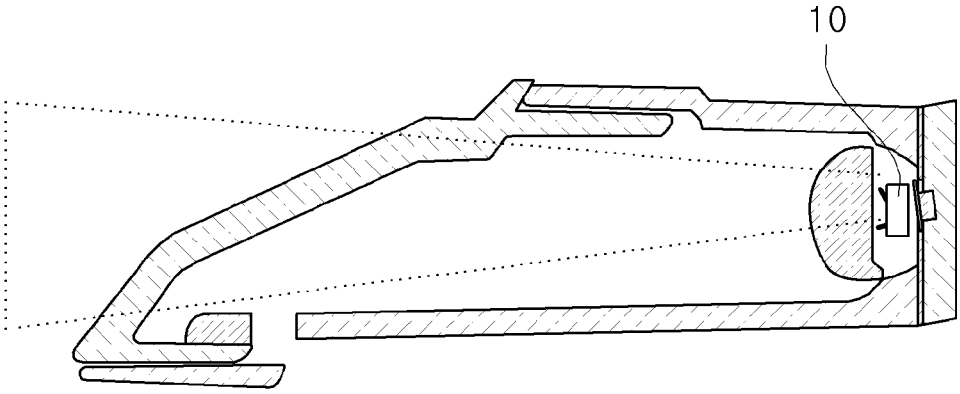
FIG. 2 is a view of a direct type light source emitting method of the related art.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Currently, a design method which may improve light uniformity of an FDT surface light source has been progressed through the number of trial and error so that lots of labors and times are allocated. The present invention provides a method for a mathematized optimal lamp design for an automobile which may solve the above-mentioned technical problems.

Hereinafter, a lamp design method for an automobile according to the present invention will be described with reference to accompanying drawings.

Figure 3:
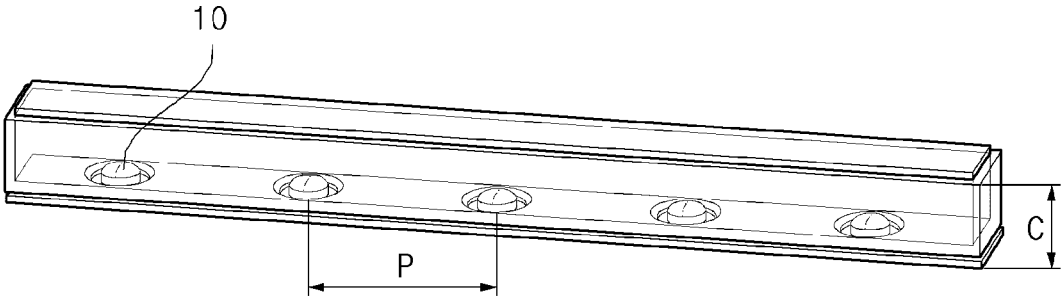
FIG. 3 is a view illustrating a pitch between light sources and an air gap according to an exemplary embodiment.

FIG. 3 is a view illustrating a pitch between light sources and an air gap according to an exemplary embodiment. Referring to FIG. 3, the light uniformity of the FDT is a function of a pitch between LEDs and an air gap. In order to improve a specific light uniformity, variables of the pitch P and the air gap C need to be appropriately combined. By the correlation, the light uniformity may be improved and the number of light sources 10 such as LED may be reduced. The present invention positively verifies the correlation and suggests a mathematical model.

According to the exemplary embodiment of the present invention, functions of a pitch P between the light sources 10 and an air gap C which are variables for improving light uniformity are combined to be applied to the design. Specifically, referring to FIG. 1, the pitch P, which is a distance between the light sources 10 such as LEDs, is designed to be 50 to 80 mm and the air gap C, which is a height of an inside of a cover in which the light source 10 is provided, is designed to be 20 to 40 mm.

The light uniformity may be expressed by the following equation.

$$\text{Light uniformity} = 0.962046 + 0.00623107 \times (\text{air gap}) - 0.00444847 \times (\text{pitch}). \quad \text{Equation 1}$$

The "air gap" and the "pitch" are variables. "20 to 40 mm" is substituted as a value of the "air gap", as described above. "50 to 80 mm" is substituted as a value of the "pitch", as described above. The light uniformity may be applied to light uniformity of a direct type surface light source such as an LED. Except for the "air gap" and the "pitch" in the equation for the light uniformity, the values of "0.962046", "0.00623107", and "0.00444847" are fixed values. The fixed values may be set data values or values obtained by an experiment.

When a specific uniformity demanding specification is fixed by original equipment manufacturing (OEM), the light uniformity may satisfy a desired demanding specification by adjusting the pitch P and the air gap C.

Figure 4:
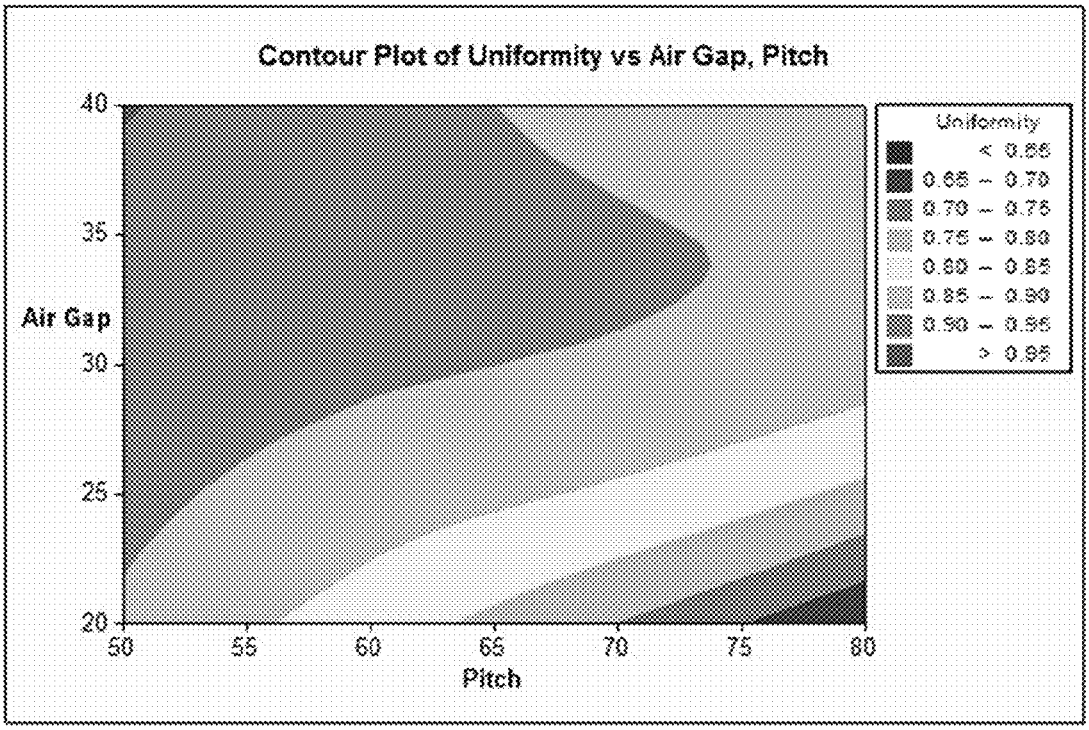
FIG. 4 is a view illustrating a contour plot of uniformity vs. an air gap and a pitch according to an exemplary embodiment.

FIG. 4 is a view illustrating a contour plot of uniformity vs. an air gap and a pitch according to an exemplary embodiment. As illustrated in FIG. 4, the pitch P and the air gap C may be illustrated on a contour plot.

As described above, the lamp design method for an automobile according to an exemplary embodiment of the present invention may provide a mathematized optimal lamp design method of an FDT surface light source lamp. Further, uniformity may be improved and the number of LEDs may be reduced. Further, the light uniformity is mathematized so that a data value of the light uniformity is easily calculated only by substituting variables of the "pitch" and the "air gap", which are set as values in a predetermined range, in any cases, thereby significantly reducing trials and errors for improving the light uniformity of the FDT surface light source.

As described above, the exemplary embodiments have been described and illustrated in the drawings and the specification. The exemplary embodiments were chosen and described in order to explain certain principles of the invention and their practical application, to thereby enable others skilled in the art to make and utilize various exemplary embodiments of the present invention, as well as various alternatives and modifications thereof. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A method for making a lamp for an automobile, wherein the lamp includes a plurality of light sources and a cover filled with air, the method comprising:

determining a distance between centers of adjacent light sources and a length of an air gap according to a value of light uniformity, the length of the air gap corresponding to a height of the cover, the value of light uniformity being equal to 0.962046+0.00623107×(the length of the air gap)−0.00444847×(the distance);

placing the plurality of light sources in a bottom portion of the cover, the centers of adjacent light sources being the determined distance apart, each of the plurality of light sources being a light emitting diode (LED) and emitting light directly to the air in the cover; and providing the cover with the height that is based on the determined length of the air gap.

2. The method of claim 1, wherein the distance is in a range from 50 to 80 mm.

3. The method of claim 2, wherein the length of the air gap is in a range from 20 to 40 mm.

4. The method of claim 1, wherein the plurality of light sources are uniformly spaced apart from each other by the determined distance.

5. The method of claim 1, wherein the length of the air gap is a first parameter and the distance is a second parameter, and wherein determining the distance and the length of the air gap includes:

determining the first parameter or the second parameter; and obtaining the second parameter based on the determined first parameter and the value of light uniformity, or obtaining the first parameter based on the determined second parameter and the value of light uniformity.

6. A lamp of an automobile comprising:

a cover filled with air; and a plurality of light sources disposed in a bottom portion of the cover, each of the plurality of light sources being a light emitting diode (LED) and emitting light directly to the air in the cover, wherein adjacent light sources are spaced apart from each other by a distance and the cover has a height that corresponds to a length of an air gap, the distance and the length of the air gap being determined according to a value of light uniformity, the value of light uniformity being equal to 0.962046+0.00623107×(the length of the air gap)−0.00444847×(the distance).

7. The lamp of claim 6, wherein the plurality of light sources are uniformly spaced apart from each other by the determined distance.

8. A method for making a lamp for an automobile, wherein the lamp includes a plurality of light sources and a cover filled with air, the method comprising:

determining a distance between centers of adjacent light sources and a length of an air gap according to a value of light uniformity, the length of the air gap corresponding to a height of the cover, the value of light uniformity being equal to 0.962046+0.00623107×(the length of the air gap)−0.00444847×(the distance);

placing the plurality of light sources in a bottom portion of the cover, the centers of adjacent light sources being the determined distance apart, each of the plurality of light sources being a light emitting diode (LED) and emitting light to the air in the cover; and providing the cover with the height that is based on the determined length of the air gap.

9. The method of claim 8, wherein the length of the air gap is a first parameter and the distance is a second parameter, and wherein determining the distance and the length of the air gap includes:

determining the first parameter or the second parameter; and obtaining the second parameter based on the determined first parameter and the value of light uniformity, or obtaining the first parameter based on the determined second parameter and the value of light uniformity.

10. The method of claim 8, wherein the plurality of light sources each emit light directly to the air in the cover.

* * * * *